United States Patent [19]

Isozumi et al.

[11] Patent Number: 4,891,996

[45] Date of Patent: Jan. 9, 1990

[54] ENGINE STARTER HAVING PLANET REDUCTION GEAR MECHANISM

[75] Inventors: Shuzoo Isozumi; Tetsuo Yagi, both of Hyogo, Japan

[73] Assignee: Mitsubishi Denki Kabushiki Kaisha, Tokyo, Japan

[21] Appl. No.: 137,710

[22] Filed: Dec. 24, 1987

[30] Foreign Application Priority Data

Dec. 25, 1986 [JP] Japan ..... 61-201596[U]
Dec. 25, 1986 [JP] Japan ..... 61-201597[U]
Jan. 7, 1987 [JP] Japan ..... 62-1321[U]

[51] Int. Cl.[4] ..... F02N 11/00

[52] U.S. Cl. ..... 74/6; 74/7 E; 123/179 M; 310/83

[58] Field of Search ..... 74/6, 7 R, 7 E; 123/179 M; 310/83

[56] References Cited

U.S. PATENT DOCUMENTS

| | | | |
|---|---|---|---|
| 4,488,073 | 12/1984 | Morishita | 310/83 |
| 4,507,978 | 4/1985 | Tanaka et al. | 74/7 E |
| 4,519,261 | 5/1985 | Hamano | 74/7 E |
| 4,525,632 | 6/1985 | Tanaka | 290/38 R |
| 4,573,364 | 3/1986 | Givan | 74/7 E |
| 4,651,575 | 3/1987 | Morishita et al. | 74/7 E |
| 4,673,836 | 6/1987 | Akiyama et al. | 310/239 |
| 4,712,451 | 12/1987 | Morishita et al. | 74/801 |
| 4,760,274 | 7/1988 | Isozumi | 290/48 |

FOREIGN PATENT DOCUMENTS

| | | |
|---|---|---|
| 0180016 | 7/1986 | European Pat. Off. . |
| 2108627 | 5/1983 | United Kingdom . |
| 2109893 | 6/1983 | United Kingdom . |
| 2117836 | 10/1983 | United Kingdom . |
| 2125928 | 3/1984 | United Kingdom . |

*Primary Examiner*—Leslie A. Braun
*Assistant Examiner*—Scott Anchell
*Attorney, Agent, or Firm*—Sughrue, Mion, Zinn, Macpeak and Seas

[57] ABSTRACT

A cylindrical yoke 3 of a d.c. motor of an engine starter having a planet reduction gear mechanism and a bracket 5 fitted on an extension of the yoke without relative rotation therebetween is formed integrally on an inner surface of the extension with internal gear teeth 4 of the planet reduction gear mechanism, which mesh with a solar gear 6 formed integrally on an armature shaft 2 of the motor through planet gears 7 supported by a flange 10 of an output shaft 11 of the starter. The motor is separated from the planet reduction gear mechanism by a flange 3*b*, 22 arranged therebetween and supporting a bearing 16 which supports the armature shaft.

4 Claims, 2 Drawing Sheets

ENGINE STARTER HAVING PLANET REDUCTION GEAR MECHANISM

BACKGROUND OF THE INVENTION

The present invention relates to an engine starter and, particularly, to an improvement of such starter having a planet type reduction gear mechanism.

FIG. 1 shows a typical example of a conventional engine starter having a planet type gear reduction mechanism. In FIG. 1, the engine starter comprises an electric d.c. motor having an armature 1 rotatably supported by a shaft 2 and a yoke 3 in the form of cylinder having a wall 31 and a front bracket 5 on an inner surface of which a component of a planet reduction gear mechanism is formed integrally. The component comprises an internal gear member in the form of a flange including an axial annular tooth portion extending toward the yoke 3 and having an inner surface formed integrally with gear teeth 4, and an annular projection 41 which is coaxial with the annular tooth portion in the opposite direction and defines a center hole. A solar gear 6 is formed on a front end portion of the armature shaft 2, with which planet gears 7 are meshed. The planet gears 7 are supported by bearings 8 which are, in turn, supported by support pins 9 implanted in a flange 10 of an output shaft 11. The output shaft 11 is supported by a sleeve bearing 12 which is supported by an inner periphery of the center hole of the annular projection 41 of the internal gear member. The front end portion of the armature shaft 2 is supported by a sleeve bearing 13 fixedly provided in an axial hole formed in an inner peripheral surface of a rear portion of the output shaft 11. A reference numeral 14 depicts a steel sphere arranged between ends of the armature shaft 2 and the output shaft 11 and functions to receive thrust load. A reference numeral 15 denotes a permanent magnet fastened on an inner peripheral surface of the yoke 3. The flange 31 functions to provide a thrust support for the planet gears and seals the planet reduction gear mechanism from the motor portion to thereby provide a dust-free structure.

In operation, the armature 1 is energized by closing an engine key switch (not shown) and produces a rotational force under the influence of the magnetic field of the permanent magnet 15. The rotational force of the armature 1 is transmitted through the solar gear 6 on the shaft 2 to the planet gears 7 to rotate the latter to thereby rotate the output shaft 11 at a reduced speed through the flange portion 10. The rotation of the output shaft 11 is transmitted to a ring gear of an internal combustion engine (not shown) through a pinion gear of an over running clutch (not shown) which is fitted on the output shaft 11 and housed in the front bracket 5.

Since, in the conventional device, the internal gear member having internally projecting teeth which constitute a portion of the planet reduction gear mechanism is provided separately from the yoke and assembled thereto, the number of parts constituting the mechanism is relatively large, the structure thereof is relatively complicated and the assembly thereof is relatively difficult.

Further, the partitioning effect of the flange portion of the yoke arranged between the motor and the planet reduction gear mechanism is not complete due to the existence of the center hole of the flange. It is thus difficult to assure a dust-proof structure for shielding one of them with respect to the other.

A starter having a center bracket which is formed integrally with a yoke of a motor so that it covers the latter is disclosed in U.S. Pat. No. 4,454,437.

U.S. Pat. Nos. 4,488,073 and 4,520,285 disclose a starter in which an internal gear member is formed integrally with a center bracket.

In any of these prior arts, it has been found that, although the number of parts is reduced, the rotational force of the armature shaft under shock load is transmitted to the yoke, causing the operational reliability of the starter to be degraded. Further, in order to provide a dust-proof structure, these prior arts propose the use of specially designed shielding member arranged between the motor and the planet reduction gear mechanism.

SUMMARY OF THE INVENTION

The present invention was made in view of the drawbacks of the conventional device, and its object is to provide an engine starter whose number of parts is relatively small and an assembling operation thereof is relatively easy, while improving operational reliability of the starter and providing a dust-proof structure without using any special shielding member.

The engine starter according to the present invention is featured by an internal gear member constituting a planet reduction gear mechanism formed integrally with an end portion of a yoke and a flange portion having a bearing for supporting a shaft of a motor formed integrally on an inner surface of an intermediate portion of the yoke, i.e., between the motor portion and the internal gear member. With such structure of the engine starter as mentioned above, it is not necessary to provide the internal gear member and a center bracket therefore, separately, resulting in a reduction of the number of parts.

The bearing supported by the flange portion acts also as a dust-proof partition between the motor and the planet reduction gear mechanism.

The rotational force of the armature shaft under shock load is absorbed by a bracket of the starter, which is fixedly fitted peripherally to the yoke and supports the output shaft through a bearing.

DETAILED DESCRIPTION OF THE PREFERRED EMBODIMENTS

Figure 2:
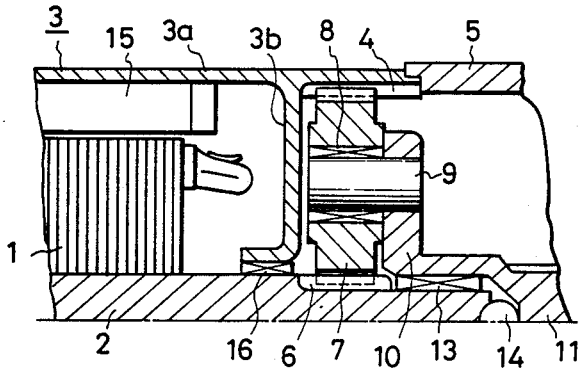
FIG. 2 is a cross sectional view of an embodiment of the present invention.

The FIG. 2 embodiment includes a d.c. motor having an armature 1, a rotary shaft 2 supporting the armature 1 and a yoke 3. The yoke 3 has a cylindrical body **3*a* including an end portion on an inner surface of which internal teeth 4 are formed integrally and an intermedial portion having a radially inwardly extending flange 3*b* formed integrally therewith. The rotary shaft 2 is supported by a bearing 16 supported by the flange 3*b*. On a front end portion of the rotary shaft 2 is a solar gear 6 formed integrally therewith, which meshes with planet gears 7 which in turn mesh with the internal teeth 4. An end portion of the yoke 3***a* is fitted to a front bracket 5 which surrounds an output shaft 11 and houses an over running clutch (not shown) mounted on the shaft 11. The fitting of the yoke 3 to the front bracket 5 will be described later.

Figure 1:
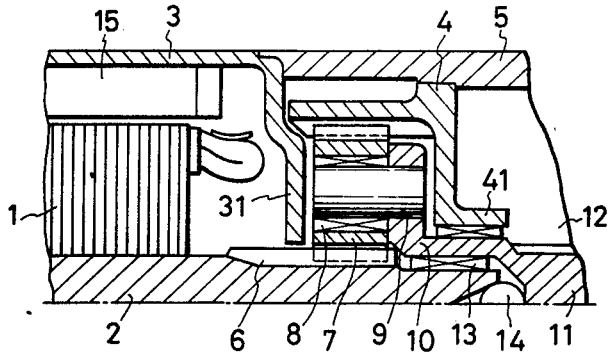
FIG. 1 PRIOR ART
FIG. 1 is a cross sectional view of a conventional engine starter including a planet gear reduction mechanism.

In this embodiment, the internal teeth 4 are integral with the yoke and the axial length of the starter is reduced since the flange 3*b* acts as a support of the internal gear. Further, due to the existence of the bearing 16, an effective partition is formed between the motor and the planet reduction gear mechanism. Other components of this embodiment than those mentioned above are substantially the same as those of the conventional device shown in FIG. 1 and therefore details thereof are omitted for avoidance of duplication. The operation of this embodiment is also the same as that of the conventional device.

Figure 3:
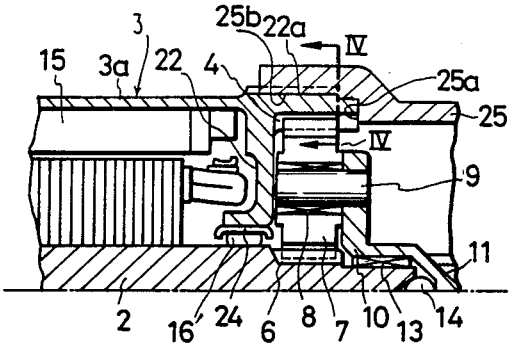
FIG. 3 is a cross section of another embodiment of the present invention.
Figure 4:
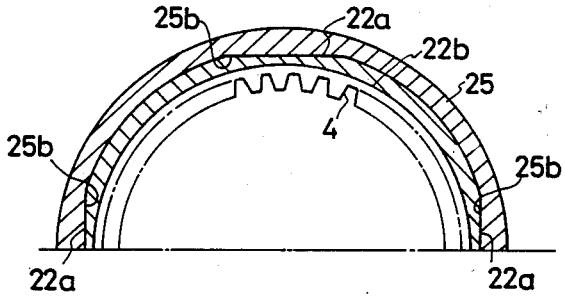
FIG. 4 is a cross section taken along a line IV—IV in FIG. 3.

FIGS. 3 and 4 show another embodiment of the present invention, wherein the yoke 3 has a generally cylindrical portion 3*a* formed integrally with a center bracket or flange 22 and with internal gear teeth 4 which mesh with planet gears 7. The center flange 22 is formed with a center hole 24 by which a bearing 16' is supported to support an armature shaft 2.

The fitting between the yoke 3 and the bracket 5 is in the form of faucet joint. As shown in FIG. 4, the outer surface of the end portion of the yoke 3 includes four arched planes 22*b* connected by four flat planes 22*a*, and an inner surface of an end portion of the bracket 25 includes corresponding four arched planes connected by four flat planes 25*b* so that, by inserting the end portion 3*a* of the yoke into the end portion of the bracket 25 until it abuts an end face 25*a* of the latter, a faucet fitting is established therebetween with no relative rotation therebetween.

Therefore, rotational force of the armature shaft 2 which usually acts on the yoke 3 to cause rotation thereof is transmitted through the faucet joint to the bracket 25 and absorbed thereby.

A distance between the fitting planes and the armature shaft is preferrably selected as being larger than that between an outer surface of the cylinder portion 3*a* of the yoke 3 and the armature shaft 2.

Figure 5:
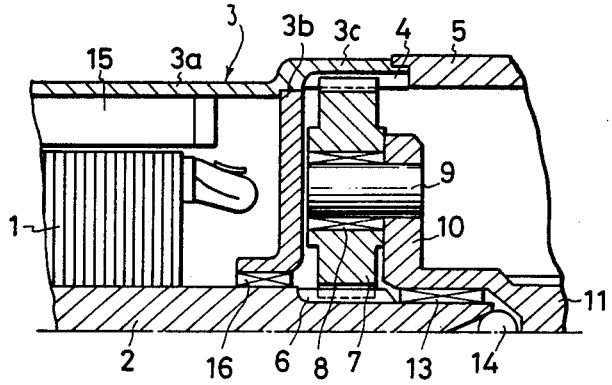
FIG. 5 is a cross section of a further embodiment of the present invention.

FIG. 5 shows another embodiment of the present invention, which is similar to that shown in FIG. 2 and in which the production of the yoke is facilitated. In FIG. 5, the only difference thereof from FIG. 2 are that an end portion 3*c* of a yoke 3 is stepped to make its diameter than that of the cylinder portion 3*a*, and that a center bracket or flange 3*b* is prepared separately and assembled to the stepped portion 3*c* of the yoke 3 as shown as a substitution for the flange 3*b* in FIG. 2. With the increased diameter of the end portion 3*c* of the yoke 3, the assembling of the center flange 3*b* is facilitated. A diameter of a front bracket 5 is increased compared with that in FIG. 2 correspondingly to the increased diameter of the end portion 3*c* of the yoke 3.

What is claimed is:

1. An engine starter for an internal combustion engine, comprising: a planet reduction gear mechanism including a solar gear (6), a plurality of planet gears (7), and an internal gear member (4), and a d.c. motor including a cylindrical yoke (3) having an axial extension formed integrally and in one piece therewith, said extension defining a housing surrounding the planet reduction gear mechanism and having a toothed inner circumferential surface defining the internal gear member, an armature (1) fixedly secured to a rotary shaft (2) of said motor defining said solar gear at one end thereof, and magnet means (15) disposed between said armature and said yoke, said axial yoke extension being non-rotatably fitted to a mounting bracket (5), said internal gear member meshing with said planet gears, which in turn mesh with said solar gear, said planet gears being supported by a flange portion (10) of an output shaft (11), and flange means (3*b;* 22) disposed between said yoke and said axial extension and extending radially inwardly therefrom for providing a partition therebetween, said flange means being formed with a center hole for supporting a bearing (16), and said rotary shaft of said motor being rotatably supported by said bearing, wherein said flange means is formed integrally and in one piece with an inner surface of said cylindrical yoke, wherein a root diameter circle of the toothed inner circumferential surface of the axial extension is substantially co-cylindrical with an inner circumferential surface of said yoke.

2. An engine starter for an internal combustion engine, comprising: a planet reduction gear mechanism including a solar gear (6), a plurality of planet gears (7), and an internal gear member (4), and a d.c. motor including a cylindrical yoke (3) having an axial extension formed integrally and in one piece therewith, said extension defining a housing surrounding the planet reduction gear mechanism and having a toothed inner circumferential surface defining the internal gear member, an armature (1) fixedly secured to a rotary shaft (2) of said motor defining said solar gear at one end thereof, and magnet means (15) disposed between said armature and said yoke, said axial yoke extension being non-rotatably fitted to a mounting bracket (5), said internal gear member meshing with said planet gears, which in turn mesh with said solar gear, said planet gears being supported by a flange portion (10) of an output shaft (11), and flange means (3*b*) disposed between said yoke and said axial extension and extending radially inwardly therefrom for providing a partition therebetween, said flange means being formed with a center hole for supporting a bearing (16), and said rotary shaft of said motor being rotatably supported by said bearing, wherein said flange means is a discrete annular disc and said axial extension is enlarged in diameter to form a stepped portion between said cylindrical yoke and said extension, said discrete annular disc being assembled to a radially inward surface of said stepped portion which is perpendicular to an axis of said rotary shaft.

3. The engine starter as claimed in claims 1 or 2, wherein said extension of said yoke is faucet fitted to said bracket.

4. The engine starter as claimed in claim 3, wherein a faucet fitting surface of said extension includes at least one flat plane and a faucet fitting surface of said bracket includes a corresponding flat plane, said flat plane of said extension and said bracket being adaped to prevent the relative rotation therebetween when faucet fitted.

* * * * *